US007620346B2

(12) United States Patent
Nakano

(10) Patent No.: US 7,620,346 B2
(45) Date of Patent: Nov. 17, 2009

(54) ELECTROPHOTOGRAPHIC IMAGE FORMING DEVICE ENABLING TO EASILY MOUNT BELT UNIT AT REGULAR POSITION

(75) Inventor: Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 217 days.

(21) Appl. No.: 11/828,068

(22) Filed: Jul. 25, 2007

(65) Prior Publication Data

US 2008/0038013 A1 Feb. 14, 2008

(30) Foreign Application Priority Data

Aug. 11, 2006 (JP) ..... 2006-220190

(51) Int. Cl.
*G03G 21/16* (2006.01)

(52) U.S. Cl. ..... 399/111; 399/113

(58) Field of Classification Search ..... 399/107, 399/110, 111, 113, 114, 302, 303, 308
See application file for complete search history.

(56) References Cited

U.S. PATENT DOCUMENTS

| | | | | |
|---|---|---|---|---|
| 7,054,578 | B2 | 5/2006 | Jung et al. | |
| 7,092,657 | B2 * | 8/2006 | Nakashima et al. | 399/111 |
| 7,212,767 | B2 * | 5/2007 | Hosokawa et al. | 399/111 |
| 7,269,378 | B2 * | 9/2007 | Baek et al. | 399/121 |
| 7,418,221 | B2 * | 8/2008 | Kyung et al. | 399/121 |
| 7,444,100 | B2 * | 10/2008 | Sato | 399/110 |
| 7,466,939 | B2 * | 12/2008 | Nakashima et al. | 399/111 |
| 7,486,906 | B2 * | 2/2009 | Jeong et al. | 399/110 |
| 7,489,889 | B2 * | 2/2009 | Sato et al. | 399/116 |
| 2005/0002687 | A1 | 1/2005 | Jung et al. | |
| 2006/0002735 | A1 | 1/2006 | Tamaru et al. | |
| 2006/0067732 | A1 | 3/2006 | Igarashi | |
| 2006/0079358 | A1 | 4/2006 | Igarashi | |
| 2006/0180973 | A1 | 8/2006 | Igarashi | |

FOREIGN PATENT DOCUMENTS

| | | |
|---|---|---|
| CN | 1577134 A | 2/2005 |
| JP | 2003-241618 | 8/2003 |
| JP | 2006-096527 | 4/2006 |

OTHER PUBLICATIONS

Office Action in Chinese Application No. 200710141948.9 mailed May 8, 2009 and English translation thereof.

* cited by examiner

*Primary Examiner*—Hoan H Tran
(74) *Attorney, Agent, or Firm*—Banner & Witcoff, Ltd.

(57) ABSTRACT

A belt unit is provided with pressure-receiving parts, and a photosensitive unit is provided with pressing parts that applies pressing force to the pressure-receiving parts when the photosensitive unit is inserted to a main body of an image forming device along a guide groove formed in the main body. The pressing force applied to the pressure-receiving parts presses the belt unit toward a regular mounting position in the main body, so that the mounting of the belt unit is completed at the same time the mounting of the photosensitive unit is completed.

13 Claims, 9 Drawing Sheets

ELECTROPHOTOGRAPHIC IMAGE FORMING DEVICE ENABLING TO EASILY MOUNT BELT UNIT AT REGULAR POSITION

CROSS REFERENCE TO RELATED APPLICATION

This application claims priority from Japanese Patent Application No. 2006-220190 filed Aug. 11, 2006. The entire content of this priority application is incorporated herein by reference.

TECHNICAL FIELD

The invention relates to an electrophotographic image-forming device.

BACKGROUND

A tandem-type color laser printer disclosed in Japanese Patent-Application Publication No. 2006-96527 includes a belt unit for conveying a recording sheet and a photosensitive unit having photosensitive drums. Since it is necessary to perform maintenance operations to fix paper jam occurred during an image forming operation in a paper conveying path or to replenish consumables, such as developer, the belt unit and the photosensitive unit are configured to be detachable from a main body of the laser printer.

In case of a configuration in which a regular mounting position of the photosensitive unit in the main body is in a path through which the belt unit is mounted to or removed from the main body, it is necessary to mount the belt unit to the main body before mounting the photosensitive unit to the main body.

With this configuration, when the photosensitive unit is inserted to the main body while the belt unit is improperly and incompletely mounted to the main body, the photosensitive unit collides with part of the belt unit, and the photosensitive unit cannot be mounted to the main body. Also, parts of the belt unit and the photosensitive unit that collide with each other may be damaged.

In order to solve this problem, it is conceivable to promote awareness about the necessity of confirming whether the belt unit has been mounted to a proper mounting position before inserting the photosensitive unit into the main body. However, this method cannot fundamentally solve the problem.

SUMMARY

In view of the foregoing, it is an object of the invention to provide an image forming device that requires to mount a belt unit to a main body before mounting a photosensitive unit to the main body and that can solve the above problems.

In order to attain the above and other object, the invention provides an electrophotographic image forming device including a main body, a belt unit, and a photosensitive unit. The belt unit is detachably mounted at a first predetermined position in the main body, and has a belt. The belt directly or indirectly conveys a developer image. The photosensitive unit is detachably mounted at a second predetermined position in the main body. The second predetermined position is in a mounting path through which the belt unit is detached from or mounted to the main body. The photosensitive unit has a photosensitive member. The belt unit is provided with a pressure-receiving part. The photosensitive unit is provided with a pressing part that contacts the pressure-receiving part and presses the belt unit toward the first predetermined position in a process of mounting the photosensitive unit to the main body. The main body is provided with a guide unit that guides the photosensitive unit to the second predetermined position in the process of mounting the photosensitive unit.

BRIEF DESCRIPTION OF THE DRAWINGS

An embodiment in accordance with the invention will be described in detail with reference to the following figures wherein.

DETAILED DESCRIPTION

An electrophotographic image forming device according to an embodiment of the invention will be described while referring to the accompanying drawings.

Figure 1:
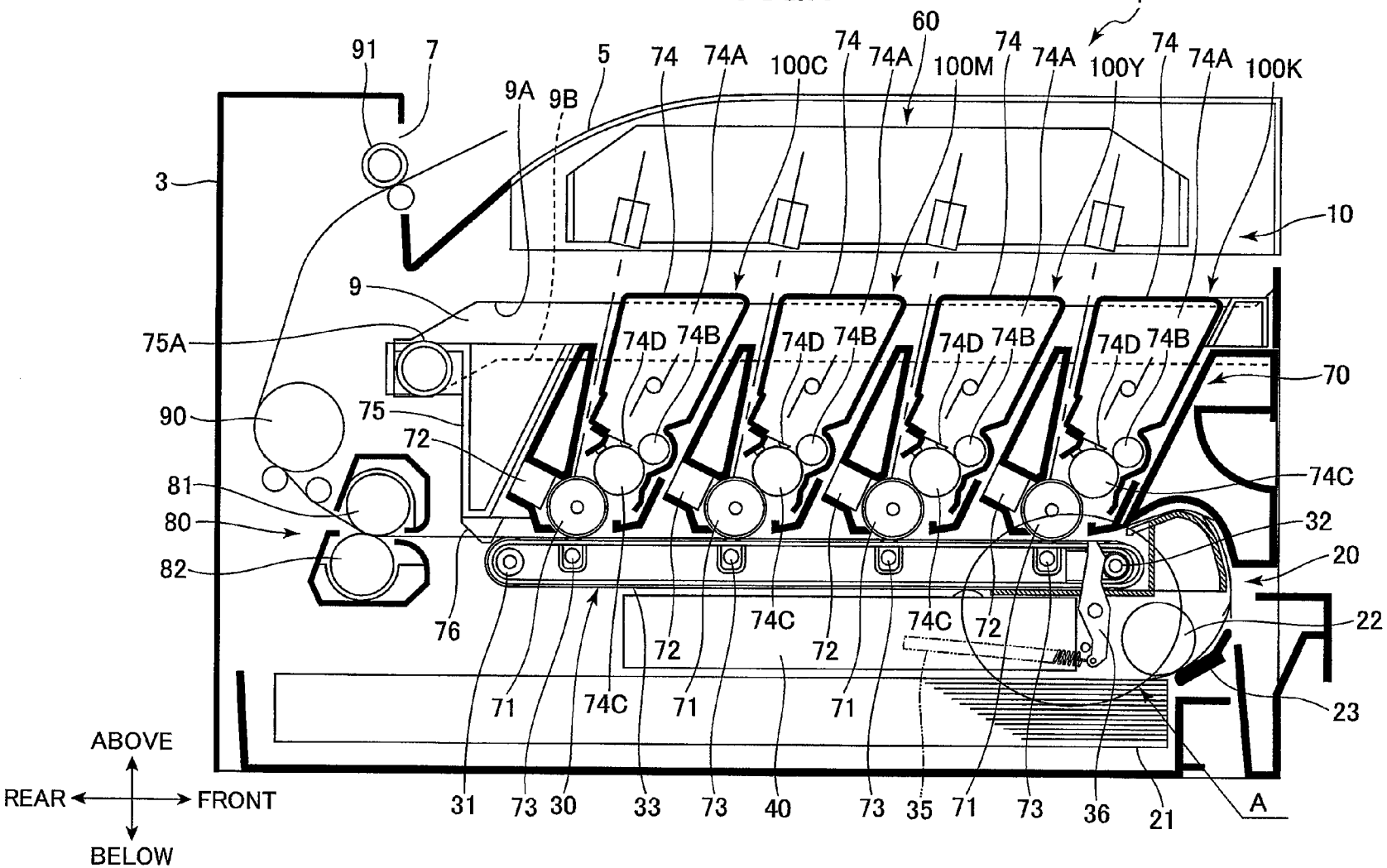
FIG. 1 is a side cross-sectional view of a laser printer according to an embodiment of the invention.

In this embodiment, the electrophotographic image forming device of the invention is applied to a laser printer 1 shown in FIG. 1. Note that in the following description, the expressions "front," "rear," "left," "right," "above," and "below" are used to define the various parts when the laser printer 1 is disposed in an orientation in which it is intended to be used.

FIG. 1 is a side cross-sectional view of the laser printer 1. It should be noted that pressure-receiving parts 37 described later are omitted from FIG. 1. It should be also noted that a mounting direction is a front-to-rear direction in this embodiment.

As shown in FIG. 1, the laser printer 1 includes a substantially box-shaped (cubic) casing 3 formed with an opening 3A (FIG. 4) at the front side. A discharge tray 5 is formed on the top surface of the casing 3 for receiving a recording sheet, such as paper sheet or OHP sheet, discharged out of the casing 3 after images have been printed thereon.

The laser printer 1 further includes, within the casing 3, an image forming unit 10 that forms an image on a recording sheet, a feeder unit 20 that feeds the recording sheet, a belt unit 30 that conveys the recording sheet fed from the feeder unit 20, a tension lever 36, and a cleaning unit 40. The image forming unit 10 employs the direct tandem system and is capable of printing color images. The image forming unit 10 includes a scanner unit 60, a photosensitive unit 70 including four photosensitive drums 71, and a fixing unit 80.

The feeder unit 20 includes a sheet feed tray 21 disposed in the bottom most section of the casing 3, a sheet feed roller 22 disposed above the front end of the sheet feed tray 21 for feeding recoding sheets stacked on the sheet feed tray 21 to the image forming unit 10, and a separation pad 23 for separating recording sheets fed by the feed roller 22 one at a time by applying a predetermined feeding resistance to the recording sheets.

A recording sheet fed from the sheet feed tray 21 is changed in its conveying direction by approximately 90 degrees to the upward direction on the front side of the sheet feed tray 21 and then by approximately 90 degrees to the horizontally rearward direction, thereby supplied to the image forming unit 10.

The belt unit 30 includes a driving roller 31 that rotates in conjunction with the operation of the image forming unit 10, a driven roller (tension roller) 32 rotatably disposed distant from the driving roller 31, and a conveying belt 33 wound about the driving roller 31 and the driven roller 32.

The recording sheet supplied from the sheet feed tray 21 is mounted on the conveying belt 33. As the conveying belt 33 rotates with the recording sheet mounted thereon, the recording sheet is sequentially conveyed to each of the four photosensitive drums 71 and then to the fixing unit 80.

The scanner unit 60 is disposed in the upper section of the casing 3 for forming an electrostatic latent image on the surface of each of the photosensitive drums 71. Although not shown in the drawings, the scanner unit 60 includes laser emitting sections, polygon mirrors, f θ lenses, reflecting mirrors, and the like.

Each laser emitting section emits a laser beam based on desired image data. The laser beam is reflected by the polygon mirror, passes through the f θ lens, is reflected by the reflecting mirror, and is reflected downward by the reflecting mirror so as to irradiate the surface of the photosensitive drum 71, thereby forming an electrostatic latent image thereon.

The photosensitive unit 70 includes a photosensitive-unit casing 75 and four developer cartridges 100K, 100Y, 100M, 100C.

The photosensitive-unit casing 75 has pressing surfaces 76 (only one pressing surface 76 is shown in FIG. 1) at both the left and right sides of the rear section. Each pressing surface 76 is smoothly and continuously inclined upward to the rear. A guide roller 75A is disposed at the rear side of the photosensitive-unit casing 75.

The developer cartridges 100K, 100Y, 100M, and 100C correspond to developer (toner) of respective colors black, yellow, magenta, and cyan, and are detachably arranged in the photosensitive-unit casing 75 along the mounting direction of the belt unit 30 in order from upstream to downstream in a sheet conveying direction of recording sheets. The four developer cartridges 100K, 100Y, 100M, and 100C have the same configuration except colors of developer. Each of the developer cartridges 100K, 100Y, 100M, and 100C includes the photosensitive drum 71, a charging unit 72, and a developer accommodating unit 74.

The photosensitive drum 71 is for bearing images to be transferred onto a recording sheet. The photosensitive drum 71 has a cylindrical shape and its outermost layer is a positively charging photosensitive layer formed of polycarbonate or the like.

The charging unit 72 is disposed diagonally above and rear of the photosensitive drum 71 and is spaced away from the photosensitive drum 71 by a predetermined space so as to avoid direct contact with the photosensitive drum 71. The charging unit 72 is a Scorotron type charge unit for generating a corona discharge from a tungsten charge wire, for example, to uniformly charge the surface of the photosensitive drum 71 with a positive polarity.

The developer accommodating section 74 is formed with a developer accommodating chamber 74A for accommodating developer. Disposed inside the developer accommodating chamber 74A are a developer supply roller 74B, a developing roller 74C, and a thickness-regulating blade 74D.

The developer accommodated in the developer accommodating chamber 74A is supplied to the developing roller 74C by the rotation of the developer supply roller 74B and is carried on the surface of the developing roller 74C. The thickness-regulating blade 74D regulates the thickness of the layer of the developer on the surface of the developing roller 74C, forming a thin layer of developer having a uniform thickness on the developing roller 27. Then, the developer is supplied to the surface of the photosensitive drum 71 which has been exposed by a laser beam from the scanner unit 60 as described above.

Transfer rollers 73 are disposed in opposition to the corresponding photosensitive drums 71 via the conveying belt 33. Each transfer roller 73 rotates in association with the rotation of the conveying belt 33 and is applied with a transfer bias with respect to the photosensitive drum 71 so as to transfer developer carried on the surface of the photosensitive drum 71 onto a printing surface of the recording sheet as the recording sheet passes by the photosensitive drum 71.

The fixing unit 80 is disposed on the downstream side of the photosensitive drums 71 with respect to the sheet conveying direction. The fixing unit 80 is for thermally fixing the developer transferred onto the recording sheet, and is detachably attached to a frame (not shown) of the laser printer 1.

Specifically, the fixing unit 80 includes a heat roller 81 and a pressure roller 82. The heating unit 81 is disposed on the printing surface side of the recording sheet and applies conveying force to the recording sheet while heating developer clinging on the recording sheet. The pressure roller 82 is disposed in confrontation with the heat roller 81 and presses a recording sheet interposed between the pressure roller 82 and the heat roller 81 against the heat roller 81.

The cleaning unit 40 is disposed below the belt unit 30 for removing developer clinging on the surface of the transfer belt 33.

Next, an image forming operation will be briefly described.

In the image forming unit 10, the charging unit 72 uniformly charges the surface of the photosensitive drum 71 with a positive polarity while the photosensitive drum 71 rotates. Subsequently, the surface of the photosensitive drum 71 is exposed by the high-scanning of the laser beam emitted from the scanner unit 60. As a result, an electrostatic latent image is formed on the surface of the photosensitive drum 71 corresponding to an image to be formed on the recording sheet.

When the positively charged developer carried on the surface of the developing roller 74C opposes and contacts the photosensitive drum 71 as the developing roller 74C rotates, the developer is selectively supplied to the electrostatic latent image on the surface of the photosensitive drum 71, i.e., to areas of the surface of the uniformly charged photosensitive drum 71 that were exposed to the laser beam and, therefore, have a lower potential than the rest of the surface. As a result, the electrostatic latent image on the photosensitive drum 71 is transformed into a visible developer image. In this way, a reverse development is performed.

The developer image carried on the surface of the photosensitive drum 71 is transferred to the recording sheet due to the transfer bias applied to the transfer roller 73. The recording sheet with the developer image transferred thereon is conveyed to the fixing unit 80, where the developer image is thermally fixed onto the recording sheet. In this manner, a desired image is formed on the recording sheet.

After the image has been printed on the recording sheet, a conveying direction of the recording sheet is changed by approximately 180 degrees to the upper front direction by an intermediate feed roller 90 and a discharge shoot (not shown). Then, the recording sheet is discharged onto the discharge tray 5 through a discharge opening 7 by a discharge roller 91.

Next, the belt unit 30 will be described further in detail.

The belt unit 30 is located bellow the photosensitive unit 70 when properly mounted at a regular mounting position in the casing 3. The regular mounting position is a position at which the belt unit 30 can be normally operated. When the belt unit 30 is mounted at a position other than the regular mounting position, a recording sheet cannot be conveyed normally, leading to degradation of printing quality and/or causing paper jam.

Figure 4:
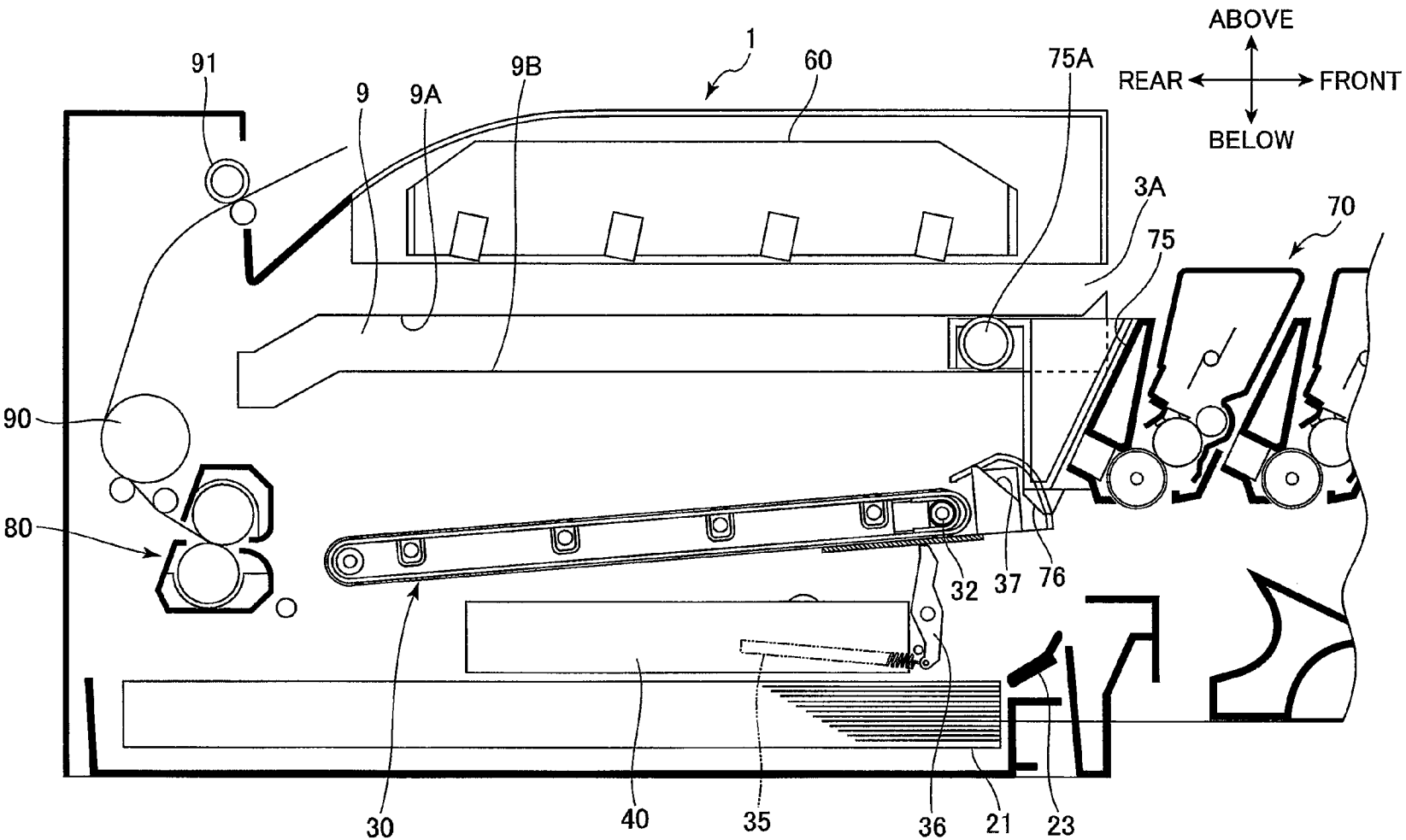
FIG. 4 is a side cross-sectional view of the laser printer explaining a process of mounting a photosensitive unit and the belt unit according to the embodiment of the invention.

Both the belt unit 30 and the photosensitive unit 70 are detachable from the casing 3. In order to mount the belt unit 30 and the photosensitive unit 70 into the casing 3, the belt unit 30 and the photosensitive nit 70 are inserted through the same opening 3A (FIG. 4) in the mounting direction which is the front-to-rear direction. A regular mounting position of the photosensitive unit 70 is in a mounting path of the belt unit 30. Accordingly, as shown in FIG. 4, it is necessary to first mount the belt unit 30 before mounting the photosensitive unit 70. Also, in order to remove the belt unit 30 from the casing 3, it is necessary to first remove the photosensitive unit 70 from the casing 3.

Figure 2:
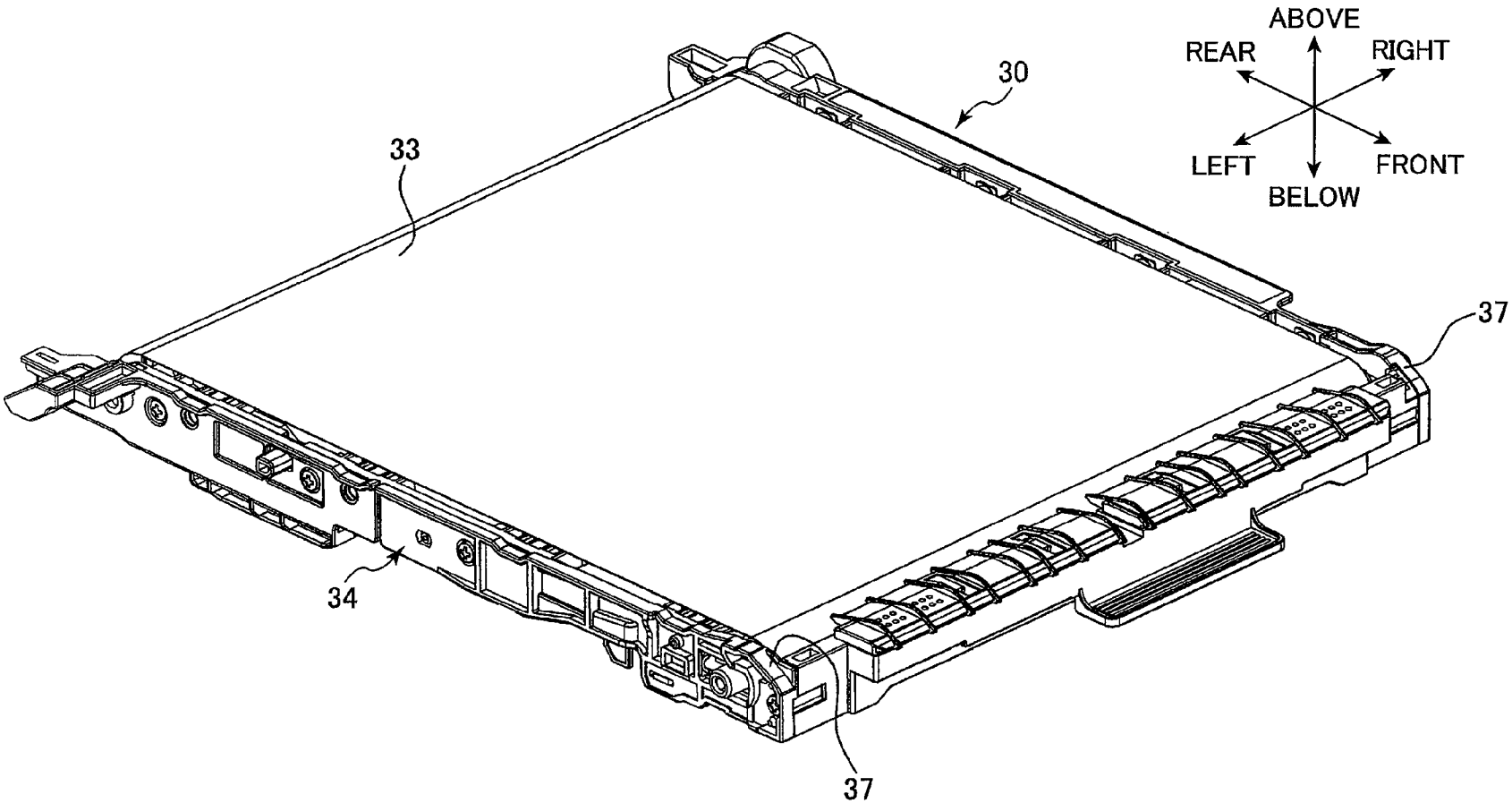
FIG. 2 is a perspective view of a belt unit of the laser printer according to the embodiment of the invention.

The belt unit 30 further includes a belt unit frame 34 shown in FIG. 2. The driving roller 31 is supported in the belt unit frame 34 via a bearing member (not shown) so as to be rotatable at a fixed position.

Figure 3:
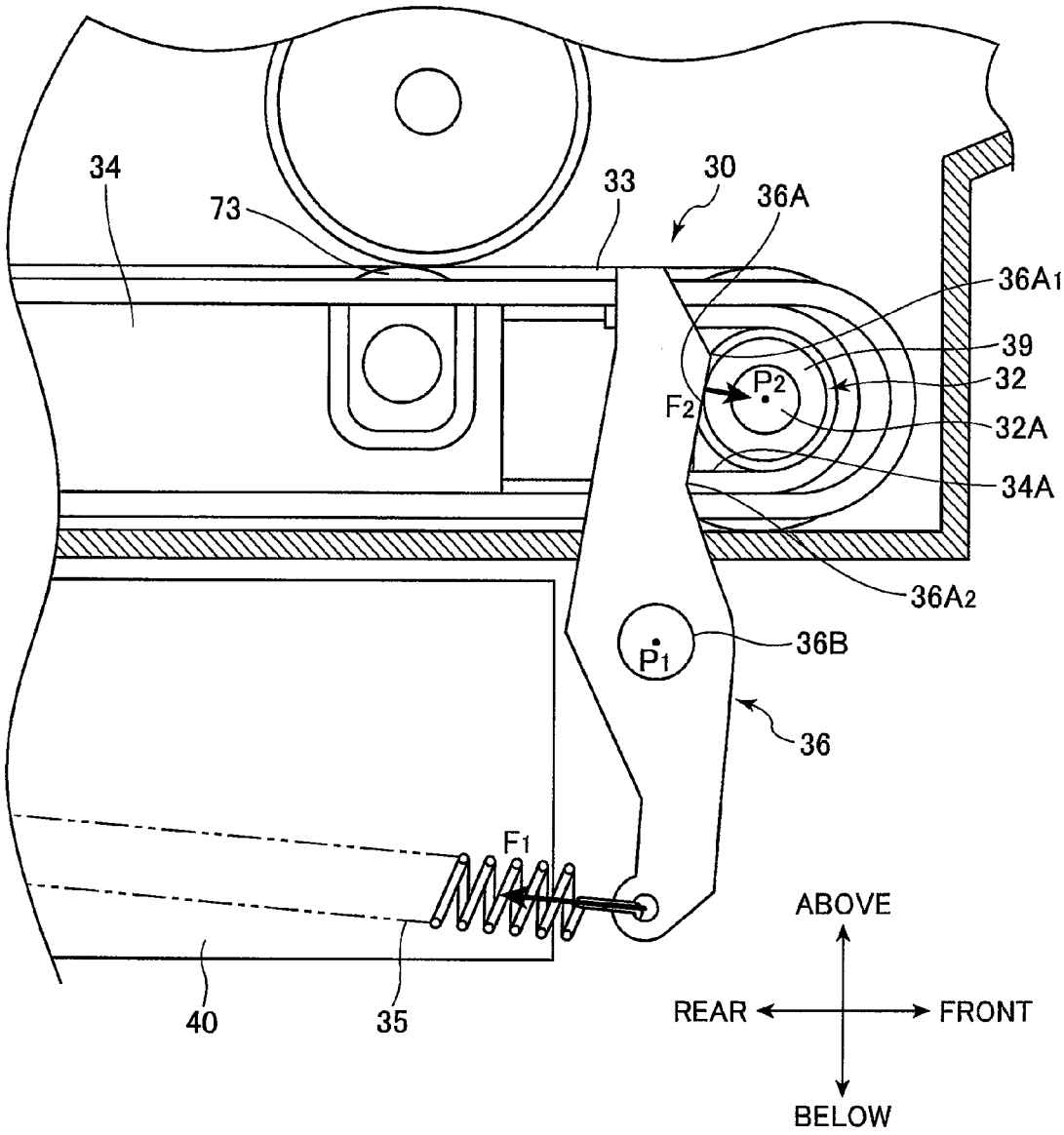
FIG. 3 is an enlarged view of an area encircled by a solid line A in FIG. 1.

As shown in FIG. 3, the driven roller 32 is integrally formed with a rotation axis 32A, which is rotatably supported in the belt unit frame 34 via a bearing member 39. Specifically, the rotation axis 32A of the driven roller 32 is received in an elongated hole 34A formed in the belt unit frame 34 via the bearing member 39, so that the rotation axis 32A can move frontward and rearward with respect to the belt unit frame 34 within the elongated hole 34A, that is in a direction that the driven roller 32 approaches or separates from the driving roller 31.

A coil spring 35 is connected to one end of the tension lever 36, and a cam portion 36A is formed to the other end of the tension lever 36 for pressing the driven roller 32 by contacting the bearing member 39. The tension lever 36 is supported by a supporting portion 36B disposed at the center in the longitudinal direction of the tension lever 36 so as to be swingable about the supporting portion 36B.

When the belt unit 30 is pressed downward toward the regular mounting position by a predetermined amount in a process of mounting the belt unit 30 as will be described later, the tension lever 36 indirectly engages with the rotation axis 32A of the driven roller 32 through the bearing member 39, thereby pressing the driven roller 32 in a direction opposite from the driving roller 31. At the same time, the tension lever 36 fixes the belt unit 30 at the regular mounting position within the casing 3.

That is, when the belt unit 30 is mounted at the regular mounting position, a center P1 of the supporting portion 36B is located below the driven roller 32 and rearward of a rotation center P2 of the driven roller 32. Also, when the cam portion 36A is in indirect engagement with the driven roller 32, a lower point $\mathbf{36}A_2$ of the cam portion 36A is located rear of an upper point $\mathbf{36}A_1$ thereof.

In other words, when the cam portion 36A is in indirect engagement with the driven roller 32 at a position between the upper point $\mathbf{36}A_1$ and the lower point $\mathbf{36}A_2$, the cam portion 36A is inclined with respect to the vertical direction. Therefore, the tension lever 36 receives an elastic force F1 of the coil spring 35 and applies force F2 to the driven roller 32, thereby pressing the driven roller 32 downward.

Accordingly, a horizontal component of the force F2 presses the driven roller 32 in a direction opposite from the driving roller 31. As a result, predetermined tensile force is applied to the conveying belt 33. On the other hand, a component of the force F2 in a direction perpendicular to the tensile force of the conveying belt 33 (vertical component) presses and fixes the belt unit 30 to the regular mounting position in the casing 3. Further, the vertical component of the force F2 maintains the indirect engagement between the tension lever 36 and the driven roller 32.

As shown in FIG. 2, the belt unit frame 34 has pressure-receiving surfaces 37 at both the left and right sides of the front section. Similarly to the pressing surfaces 76, each pressure-receiving surface 37 is smoothly and continuously inclined upward to the rear.

As shown in FIG. 1, the laser printer 1 further includes a first rail unit 9A and a second rail unit 9B that together define a guide groove 9. The guide groove 9 is for slidingly contact the guide roller 75A of the photosensitive-unit casing 75 and guides the photosensitive unit 70 to the regular mounting position.

The guide groove 9 extends in a direction intersecting the direction of reactive force of the pressure-receiving parts 37 and substantially parallel with the mounting direction of the photosensitive unit 70. That is, the guide groove 9 extends substantially in the horizontal front-to-rear direction. The rear portion of the guide groove 9 is inclined downward to the rear.

Next, a process of mounting the photosensitive unit 70 and the belt unit 30 to the casing 3 will be described. The photosensitive unit 70 and the belt unit 30 are mounted as follows.

First, as shown in FIG. 4, the belt unit 30 is inserted into the casing 3 through the opening 3A so that the leading end of the belt unit 30 in the mounting direction is located at a predetermined position. Then, the photosensitive unit 70 is inserted into the casing 3 substantially in the horizontal direction from the opening 3A along the guide groove 9. At this time, the second rail unit 9B defining the lower edge of the guide groove 9 receives the weight of the photosensitive unit 70.

At this time, if the tension lever 36 and the driven roller 32 are not indirectly engaged with each other, that is, if the belt unit 30 is not mounted at the regular mounting position, the belt unit 30 is inclined downward to the rear as shown in FIG. 4.

Figure 5:
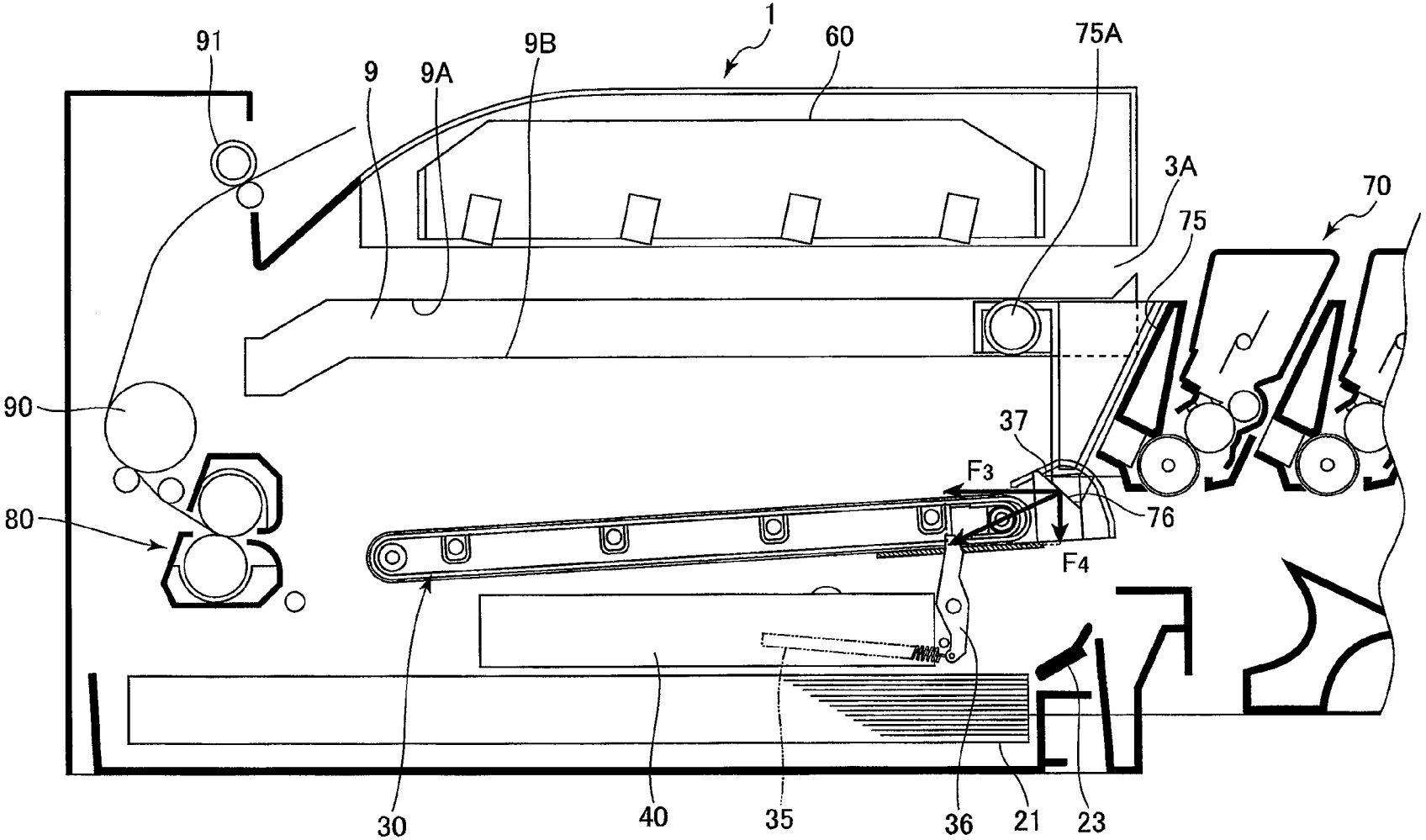
FIG. 5 is a side cross-sectional view of the laser printer explaining the process of mounting the photosensitive unit and the belt unit according to the embodiment of the invention.
Figure 6:
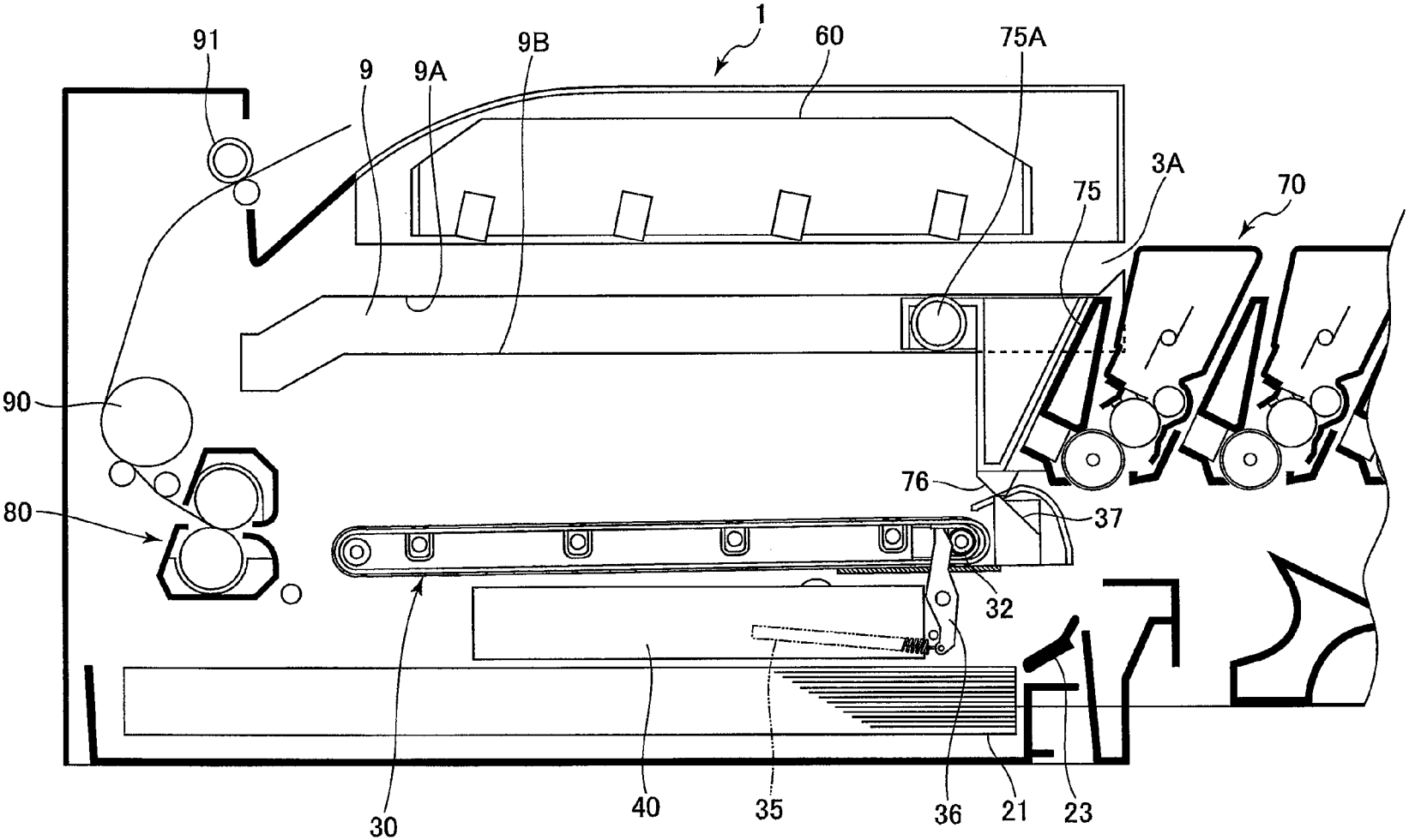
FIG. 6 is a side cross-sectional view of the laser printer explaining the process of mounting the photosensitive unit and the belt unit according to the embodiment of the invention.

If the photosensitive unit 70 is inserted further in this state, the pressing surfaces 76 provided at the leading end of the photosensitive unit 70 come into contact with the pressure-receiving surfaces 37 of the belt unit 30 as shown in FIG. 5. Since both the pressing surfaces 76 and the pressure-receiving surfaces 37 are inclined upward to the rear (to the leading side in the mounting direction), downward component F4 of force F3 at the pressing surfaces 76 for inserting the photosensitive unit 70 presses downward (in a direction parallel to a direction in which the belt unit 30 and the photosensitive unit 70 are arranged) the trailing section of the belt unit 30 in the mounting direction as shown in FIG. 6. Since both the pressing parts 76 and the pressure-receiving surfaces 37 are smoothly and continuously inclined, the pressure-receiving surfaces 37 (belt unit 30) can be smoothly pressed downward as compared with the case in which the pressing surfaces 76 and the pressure-receiving surfaces 37 are inclined stepwise.

At this time, the first rail unit 9A that defines an upper edge of the guide groove 9 contacts the upper side of the guide roller 75A and restricts the upward movement of the guide roller 75A (movement in a direction of the reactive force) and receives the reactive force from the pressure-receiving parts 37.

Figure 7:
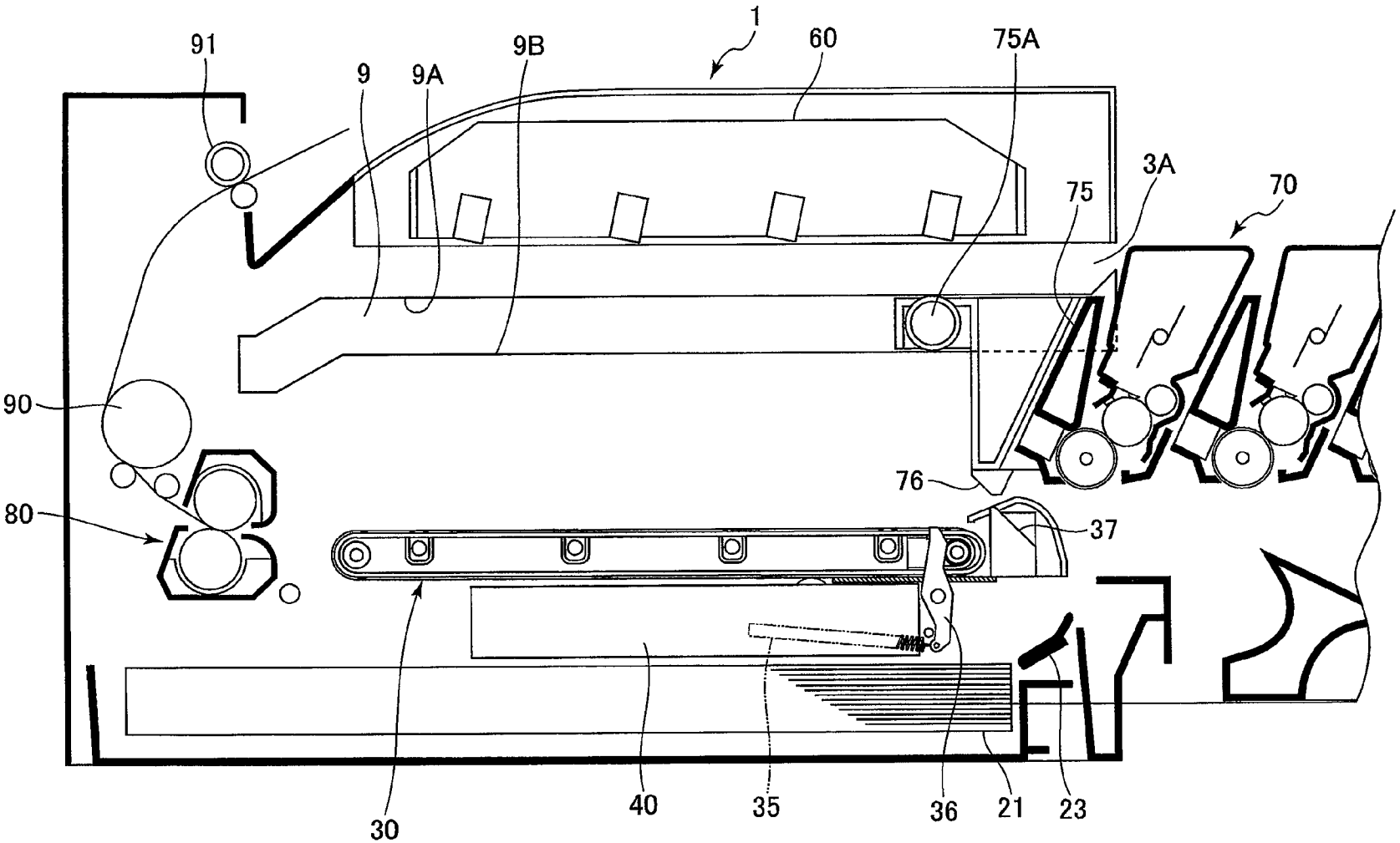
FIG. 7 is a side cross-sectional view of the laser printer explaining the process of mounting the photosensitive unit and the belt unit according to the embodiment of the invention.

When the trailing section of the belt unit 30 is displaced downward in this manner, the tension lever 36 engages with the driven roller 32 as shown in FIGS. 3 and 7. As a result, the belt unit 30 is fixed to the casing 3 at the regular mounting position, and predetermined tensile force is applied to the conveying belt 33.

Figure 8:
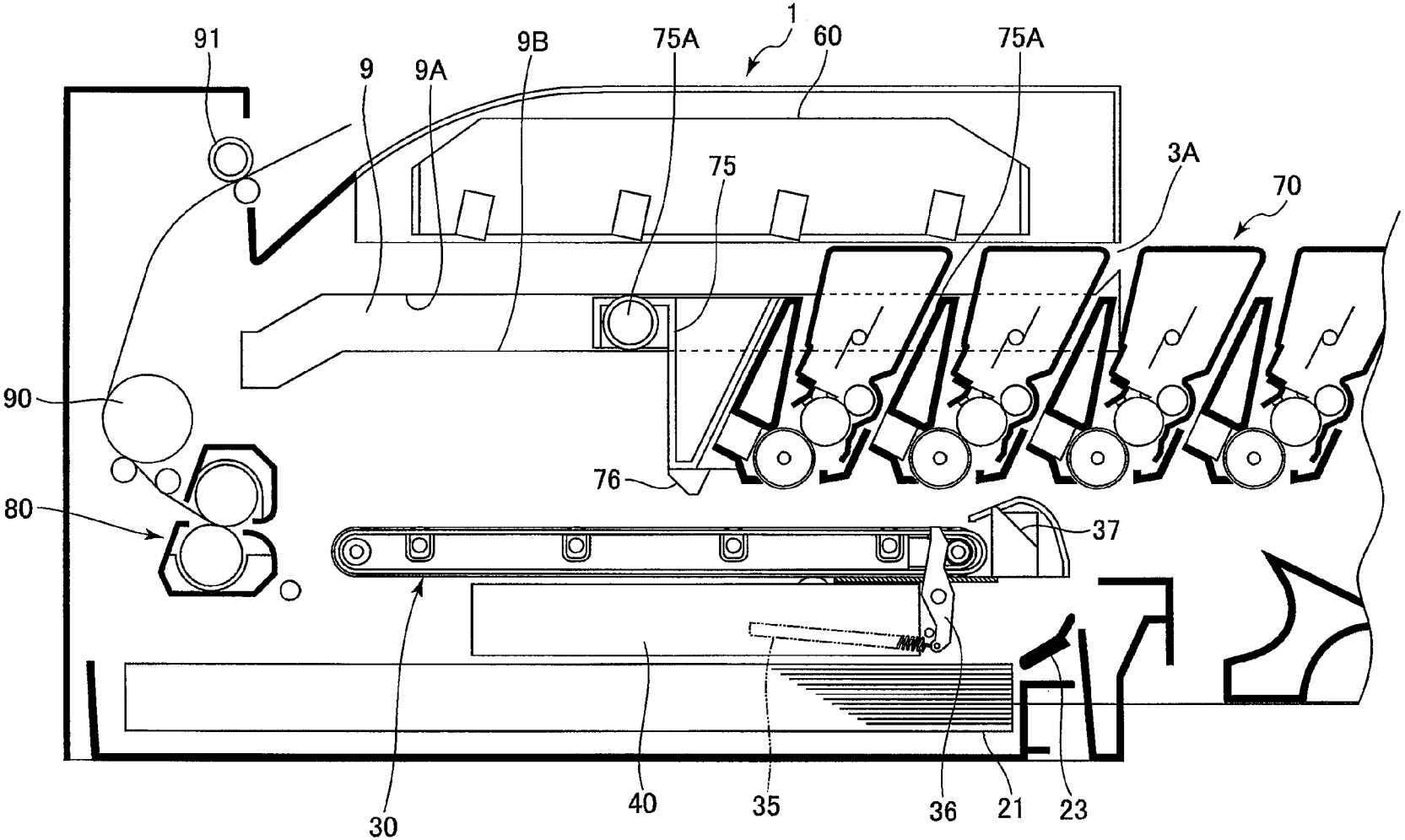
FIG. 8 is a side cross-sectional view of the laser printer explaining the process of mounting the photosensitive unit and the belt unit according to the embodiment of the invention.

When insertion of the photosensitive unit 70 is continued in this state, the photosensitive unit 70 is guided to the regular mounting position by the guide groove 9 as shown in FIG. 8. Then, the photosensitive unit 70 is completely mounted at the regular mounting position as shown in FIG. 9.

Figure 9:
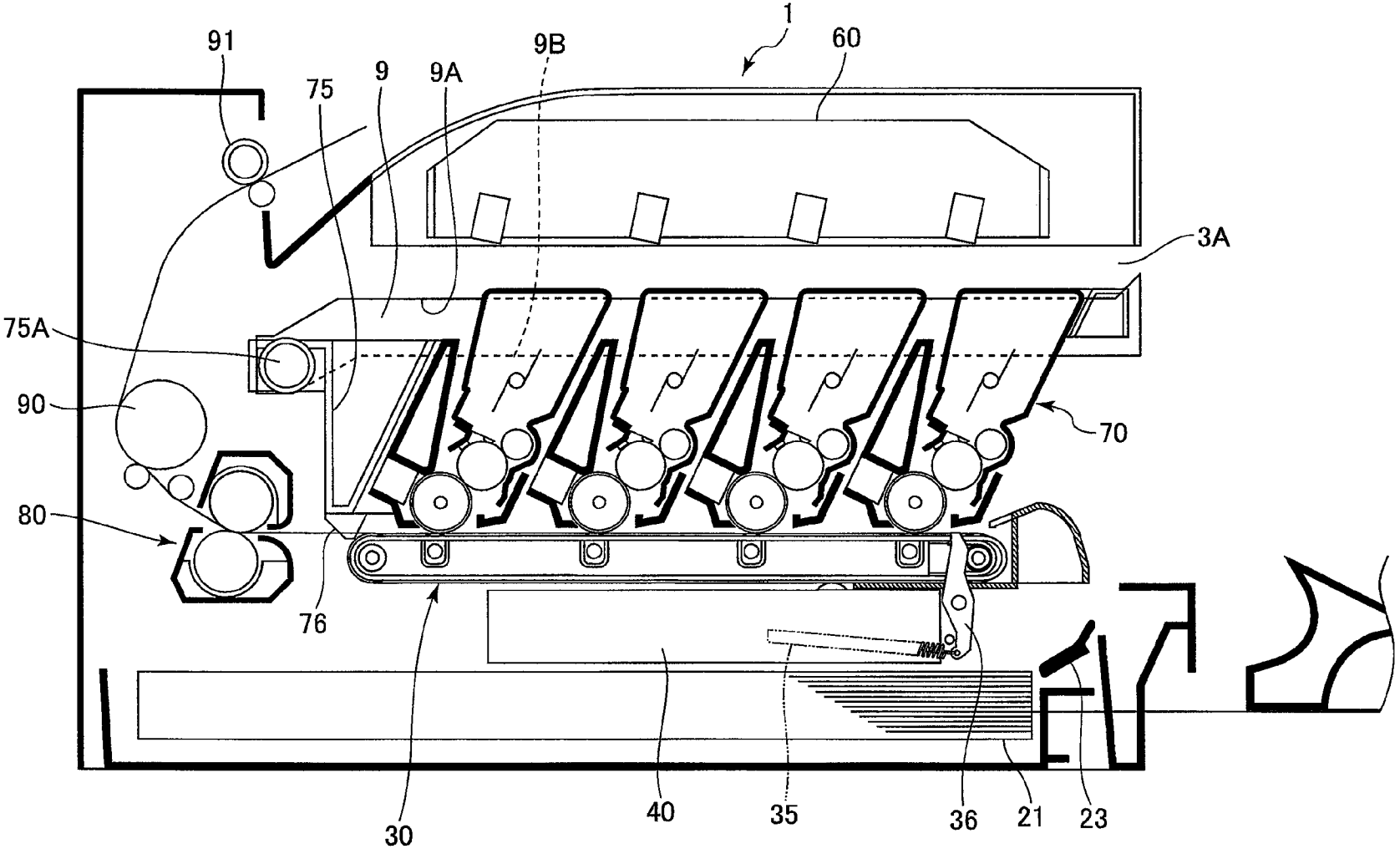
FIG. 9 is a side cross-sectional view of the laser printer explaining the process of mounting the photosensitive unit and the belt unit according to the embodiment of the invention.

When the belt unit 30 and the photosensitive unit 70 are mounted at the respective regular mounting positions as shown in FIG. 9, the pressing surfaces 76 are separated from the pressure-receiving surfaces 37.

As described above, according to the present embodiment, even if the photosensitive unit 70 is inserted into the casing 3 while the belt unit 30 is incompletely mounted, the pressure-receiving surfaces 37 of the belt unit 30 receive pressing force from the pressing surfaces 76 of the photosensitive unit 70 so that the belt unit 30 is moved to the regular mounting position as the photosensitive unit 70 is inserted. Therefore, mounting of the belt unit 30 can be completed at the same time the mounting of the photosensitive unit 70 is completed. Also, this construction solves the problem that the photosensitive unit 70 is prevented from being mounted to the casing 3 by colliding with the belt unit 30. This construction also prevents damages to parts of the belt unit 30 and the photosensitive unit 70 (especially, the surfaces of the photosensitive drums 71 and the surface of the conveying belt 33) that collide with each other.

Also, since the pressing surfaces 76 are provided at the leading end of the photosensitive unit 70 in the inserting direction so that the pressing surfaces 76 first come into contact with the pressure-receiving surfaces 37, parts of the photosensitive unit 70 other than the pressing surfaces 76 can be prevented from contacting the pressure-receiving surfaces 37 before the pressing surfaces 76 come into contact with the same, and thus can be prevented from being damaged.

Further, since the photosensitive unit 70 is guided by the guide groove 9, the photosensitive unit 70 can be easily mounted at the regular mounting position, and the pressing surfaces 76 can press the pressure-receiving parts 37 with precision. Accordingly, the belt unit 30 can be pressed toward the regular mounting position with precision, and thus the belt unit 30 can be mounted at the regular mounting position.

Moreover, since the first rail unit 9A receives the reactive force from the pressure-receiving surfaces 37 and restricts the displacement of the guide roller 75A in the direction of the reactive force during the process of mounting the photosensitive unit 70, it is unnecessary for a user to apply force to counter the reactive force to the photosensitive unit 70, and thus the user can easily and reliably mount the belt unit 30 and the photosensitive unit 70 to the casing 3.

While the invention has been described in detail with reference to the above embodiment thereof, it would be apparent to those skilled in the art that various changes and modifications may be made therein without departing from the spirit of the invention.

For example, in the above-described embodiment, the coil spring 35 and the tension lever 36 together serve as both a biasing means and a belt unit fixing mechanism. However, the biasing means and the belt unit fixing mechanism may be configured separate from each other.

Also, the first rail unit 9A that receives the reactive force is provided in the above-described embodiment. However, this configuration is not a limitation of the invention.

Further, in the above-described embodiment, the invention is applied to a laser printer 1 employing the direct tandem system that directly transfer a developer image from the photosensitive drum 71 to a recording sheet. However, the invention is also applicable to an image forming device in which a developer image is first transferred onto an intermediate transfer belt and then to a recording sheet.

In above-described embodiment, the belt unit and the photosensitive unit 70 are arranged in the vertical direction. However, the belt unit 30 and the photosensitive unit 70 may be arranged in the horizontal direction.

What is claimed is:

1. An electrophotographic image forming device comprising:

a main body;

a belt unit that is detachably mounted at a first predetermined position in the main body, the belt unit having a belt that directly or indirectly conveys a developer image; and a photosensitive unit that is detachably mounted at a second predetermined position in the main body, the second predetermined position being in a mounting path through which the belt unit is detached from or mounted to the main body, the photosensitive unit having a photosensitive member, wherein:

the belt unit is provided with a pressure-receiving part;

the photosensitive unit is provided with a pressing part that contacts the pressure-receiving part and presses the belt unit toward the first predetermined position in a process of mounting the photosensitive unit to the main body; and the main body is provided with a guide unit that guides the photosensitive unit to the second predetermined position in the process of mounting the photosensitive unit.

2. The electrophotographic image forming device according to claim 1, wherein when the belt unit and the photosensitive unit are at the first and second predetermined positions, respectively, the pressing part is separated from the pressure-receiving part.

3. The electrophotographic image forming device according to claim 1, wherein:

the belt unit and the photosensitive unit are arranged in a first direction within the main body;

the photosensitive unit is inserted into the main body in a second direction intersecting the first direction in a process of mounting the photosensitive unit; and the guide unit includes a reactive-force-receiving member that receives a reactive force from the pressure-receiving part.

4. The electrophotographic image forming device according to claim 3, wherein the reactive-force-receiving member is a rail that extends in a third direction substantially parallel with the second direction and intersecting a direction of the reactive force.

5. The electrophotographic image forming device according to claim 3, wherein the pressing part is formed at a leading side of the photosensitive unit in the second direction.

6. The electrophotographic image forming device according to claim 3, wherein the photosensitive unit is disposed above the belt unit, and the pressing part is inclined upward to the leading side in the second direction.

7. The electrophotographic image forming device according to claim 6, wherein the belt unit is inserted into the main body in a fourth direction in a process of mounting the belt unit to the main body, the fourth direction being substantially in parallel with the second direction, and the pressure-receiving part is inclined upward to the leading side in the fourth direction.

8. The electrophotographic image forming device according to claim 7, wherein the pressure-receiving part is formed at a trailing side of the belt unit in the fourth direction.

9. The electrophotographic image forming device according to claim 1, further comprising a biasing member, wherein the belt unit further includes a driving roller that rotates the belt and a tension roller that applies a tensile force to the belt, and the biasing member biases the tension roller to generate the tensile force in the belt when the belt unit is mounted at the first predetermined position.

10. The electrophotographic image forming device according to claim 9, further comprising a fixing mechanism that fixes the belt unit at the first predetermined position when the belt unit is pressed toward the first predetermined position by a predetermined amount in a process of mounting the belt unit.

11. The electrophotographic image forming device according to claim 9, wherein the biasing member engages with the tension roller, thereby fixing the belt unit at the first predetermined position.

12. The electrophotographic image forming device according to claim 1, wherein the photosensitive unit includes a plurality of photosensitive members aligned in parallel with a conveying direction in which a recording medium is conveyed.

13. The electrophotographic image forming device according to claim 12, wherein the photosensitive unit is inserted into the main body in a second direction in a process of mounting the photosensitive unit to the main body, and the photosensitive members are aligned in a fifth direction substantially in parallel with the second direction.

* * * * *